US011594830B2

(12) United States Patent
Maeta et al.

(10) Patent No.: US 11,594,830 B2
(45) Date of Patent: Feb. 28, 2023

(54) CONTACT

(71) Applicant: J.S.T. MFG. CO., LTD., Tokyo (JP)

(72) Inventors: Yuki Maeta, Osaka (JP); Kosuke Takematsu, Osaka (JP)

(73) Assignee: J.S.T. MFG. CO., LTD., Tokyo (JP)

( * ) Notice: Subject to any disclaimer, the term of this patent is extended or adjusted under 35 U.S.C. 154(b) by 0 days.

(21) Appl. No.: 17/373,472

(22) Filed: Jul. 12, 2021

(65) Prior Publication Data

US 2022/0021138 A1 Jan. 20, 2022

(30) Foreign Application Priority Data

Jul. 17, 2020 (JP) ..... JP2020-123248

(51) Int. Cl.

| | |
|---|---|
| ***H01R 12/57*** | (2011.01) |
| ***H01R 12/58*** | (2011.01) |
| ***H01R 12/71*** | (2011.01) |
| ***H01R 13/11*** | (2006.01) |

(52) U.S. Cl.

CPC ..... *H01R 12/57* (2013.01); *H01R 12/58* (2013.01); *H01R 12/718* (2013.01); *H01R 13/114* (2013.01); *H01R 2201/10* (2013.01)

(58) Field of Classification Search

CPC ..... H01R 12/57; H01R 12/58; H01R 12/718; H01R 13/114; H01R 2201/10; H01R 12/7076; H01R 13/115

See application file for complete search history.

(56) References Cited

U.S. PATENT DOCUMENTS

| | | | | |
|---|---|---|---|---|
| 5,707,259 | A * | 1/1998 | Ishizuka | H01R 13/113 439/852 |
| 5,947,777 | A * | 9/1999 | Chaillot | H01R 13/428 439/852 |
| 6,095,873 | A * | 8/2000 | Muramatsu | H01R 11/22 439/852 |
| 6,116,970 | A * | 9/2000 | Yamamoto | H01R 13/113 439/852 |
| 6,203,385 | B1 * | 3/2001 | Sato | H01R 43/16 439/852 |

(Continued)

FOREIGN PATENT DOCUMENTS

JP 2019-145504 A 8/2019

OTHER PUBLICATIONS

European Search Report for European Patent Application No. 21185663.8 dated Dec. 8, 2021 (9 sheets).

*Primary Examiner* — Truc T Nguyen
(74) *Attorney, Agent, or Firm* — Kratz, Quintos & Hanson, LLP

(57) ABSTRACT

A contact includes a hollow box-shaped main body portion into which a plate-shaped counterpart contact is inserted in an insertion direction. A pair of inward slantwise elastic piece portions are provided in a manner extending in the insertion direction from a pair of opposed edge portions of the insertion opening of the main body portion into the main body portion. The pair of elastic piece portions have contact portions arranged in mutually proximal portions. A pair of restricting portions provided on the main body portion are arranged to restrict the amount of deformation of the pair of elastic piece portions when the counterpart contact is inserted.

5 Claims, 13 Drawing Sheets

(56) References Cited

U.S. PATENT DOCUMENTS

| | | | | |
|---|---|---|---|---|
| 6,478,636 | B1 * | 11/2002 | Makita | H01R 13/113<br>439/852 |
| 7,140,927 | B2 | 11/2006 | Casses | |
| 8,911,253 | B2 | 12/2014 | Myer | |
| 9,941,615 | B2 | 4/2018 | Saito | |
| 2019/0267731 | A1 | 8/2019 | Dauth | |

* cited by examiner

CONTACT

CROSS REFERENCE TO RELATED APPLICATION

This application corresponds to Japanese Patent Application No. 2020-123248 filed on Jul. 17, 2020 in the Japan Patent Office, the entire disclosure of which is incorporated herein by reference.

BACKGROUND OF THE INVENTION

Field of the Invention

The present invention relates to a contact.

Description of Related Arts

In a contact assembly disclosed in Japanese Patent Application Publication No. 2019-145504, for example, a conductor rod (counterpart contact) is connected to a reception member that is fixed on an electric circuit board. The reception member includes a base ring fixed to the electric circuit board and multiple elastically deformable tongue portions protruding on one side from the base ring and arranged annularly around the conductor rod to be exposed externally.

When the counterpart contact (conductor rod) is inserted slantwise into the reception member, the tongue portions may be deformed excessively to impair the functionality of the contact.

SUMMARY OF THE INVENTION

A preferred embodiment of the present invention provides a contact in which an elastic piece portion can be prevented from being deformed excessively.

A preferred embodiment of the present invention provides a contact including a hollow box-shaped main body portion formed with an insertion opening into which a plate-shaped counterpart contact is inserted in an insertion direction, a pair of cantilevered elastic piece portions provided in an inward slantwise extending manner in the insertion direction from a pair of opposed edge portions of the insertion opening into the main body portion, the elastic piece portions having contact portions arranged in mutually proximal portions, and a pair of restricting portions provided on the main body portion and each arranged to restrict an amount of deformation of a corresponding one of the elastic piece portions when the counterpart contact is inserted.

In accordance with the arrangement above, when the counterpart contact is inserted between the pair of elastic piece portions within the main body portion, the restricting portions can prevent the pair of elastic piece portions from being deformed excessively.

In a preferred embodiment of the present invention, the pair of elastic piece portions include a pair of main piece portions provided inward slantwise in the insertion direction, a pair of extending piece portions provided in an outward slantwise extending manner in the insertion direction from the pair of main piece portions, and a pair of first outward protrusions protruding laterally outward from a pair of lateral edge portions of each of the extending piece portions, the contact portions are each arranged on top of a ridge between each main piece portion and each extending piece portion, and each of the restricting portions includes a pair of first restricting grooves formed in a pair of side wall portions of the main body portion, into which the pair of first outward protrusions of the corresponding one of the elastic piece portions are inserted respectively.

In accordance with the arrangement above, the pair of extending piece portions are provided in an outward slantwise extending manner in the insertion direction from the inward slantwise main piece portions of the pair of elastic piece portions. The pair of first outward protrusions protruding laterally outward from the pair of lateral edge portions of each extending piece portion are inserted, respectively, within the first restricting grooves in the pair of side wall portions of the main body portion. Each first outward protrusion engaging with the inner surface of the corresponding first restricting groove prevents the pair of elastic piece portions from being deformed excessively.

In a preferred embodiment of the present invention, each of the first outward protrusions has a rectangular cross section, and each of the first restricting grooves has a fan shape expanding in an extension direction of each of the extending piece portions in which a corresponding one of the first outward protrusions is provided in an extending manner. In accordance with this arrangement, the inner surface of each first restricting groove can receive each rectangularly cross-sectioned first outward protrusion, with higher positional accuracy, even when displaced with the deformation of each elastic piece portion.

A preferred embodiment of the present invention further includes a pair of second outward protrusions provided in a manner extending laterally outward from a pair of lateral edge portions of each of the contact portions of the elastic piece portions, in which each of the restricting portions includes a pair of second restricting grooves formed in a pair of side wall portions of the main body portion, into which the pair of second outward protrusions of a corresponding one of the elastic piece portions are inserted respectively. In accordance with this arrangement, the pair of second outward protrusions provided in a manner extending laterally outward from the pair of lateral edge portions of each contact portion of each elastic piece portion are inserted, respectively, within the second restricting grooves in the pair of side wall portions of the main body portion. Each second outward protrusion engaging with the inner surface of the corresponding second restricting groove prevents the pair of elastic piece portions from being deformed excessively.

In a preferred embodiment of the present invention, each of the restricting portions includes restricting protrusions formed in a manner protruding from a pair of side wall portions of the main body portion and arranged to engage with the elastic piece portions in a corresponding manner. In accordance with this arrangement, the restricting protrusions formed in a manner protruding from the pair of side wall portions of the main body portion are arranged to engage with the elastic piece portions in a corresponding manner and thereby prevent the elastic piece portions from being deformed excessively.

DETAILED DESCRIPTION OF THE PREFERRED EMBODIMENTS

Preferred practical embodiments of the present invention will hereinafter be described with reference to the accompanying drawings.

First Preferred Embodiment

Figure 1A:
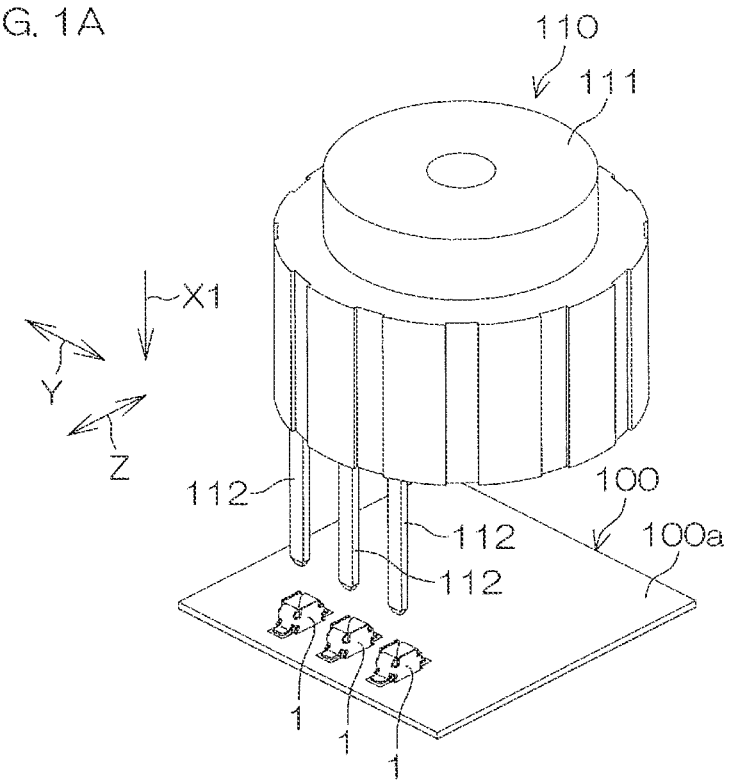
FIG. 1A is a schematic perspective view showing a state where a contact according to a first preferred embodiment of the present invention is used before connection of a counterpart contact thereto.
Figure 1B:
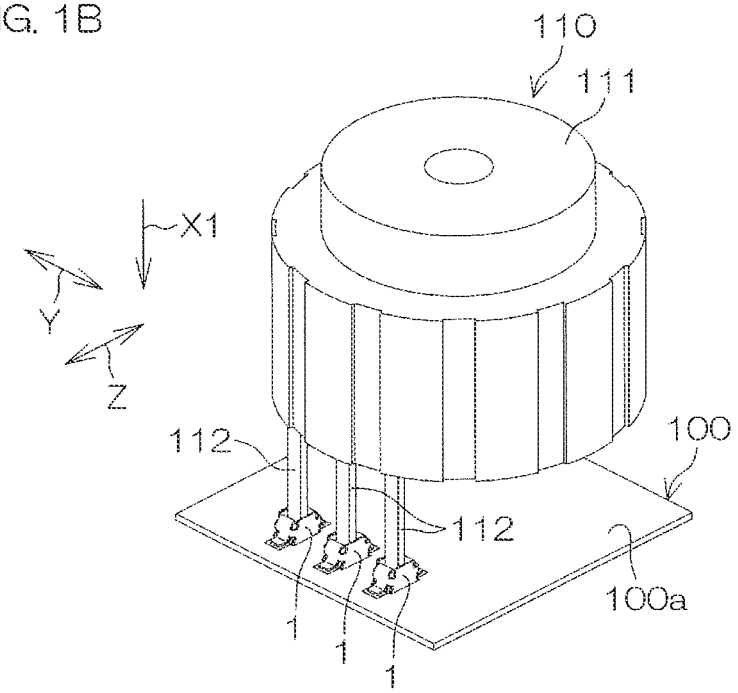
FIG. 1B is a schematic perspective view showing a state where the contact is used after connection of the counterpart contact thereto.

FIGS. 1A and 1B are schematic perspective views showing a state where a contact 1 according to a first preferred embodiment of the present invention is used. FIG. 1A shows a state before connection of a counterpart contact and FIG. 1B shows a state after connection of the counterpart contact.

As shown in FIGS. 1A and 1B, multiple contacts 1 are mounted and used side by side on a circuit board 100, for example. A motor 110 to be connected, for example, includes a motor main body 111 and multiple counterpart contacts 112 protruding from the motor main body 111.

The corresponding one of the counterpart contacts 112 is inserted and connected into each of the contacts 1 in an insertion direction X1. That is, in this preferred embodiment, the contact 1 serves as a connector for motor connection thereto. The contact 1 also forms a so-called housing-less connector, which uses no resin housing.

The counterpart contact 112 is an elongated plate-shaped contact with its longitudinal direction extending along the insertion direction X1. The counterpart contact 112 has a through-thickness direction in a left-right direction Y orthogonal to the insertion direction X1 and a predetermined width in a front-rear direction Z orthogonal to the insertion direction X1.

Figure 2A:
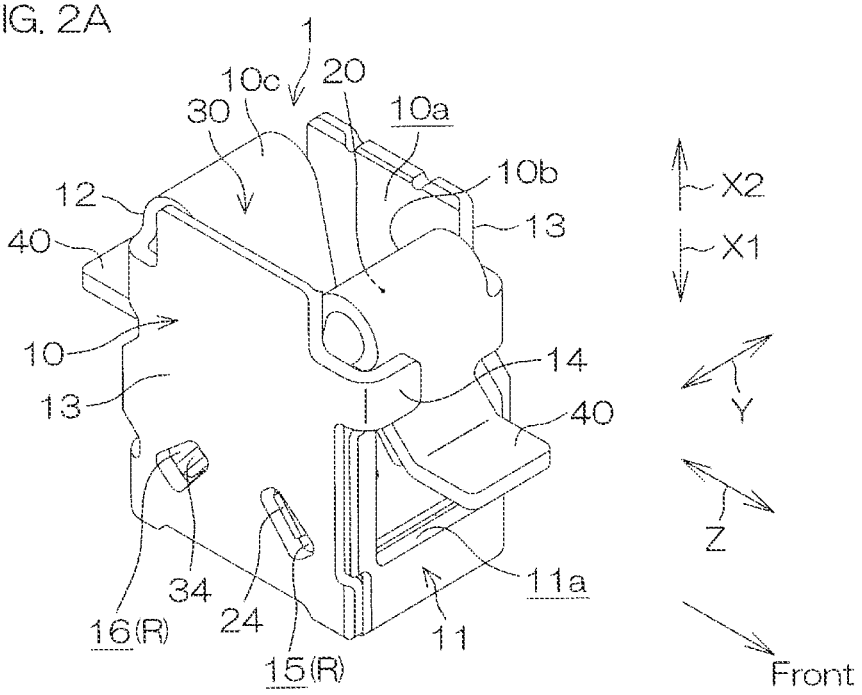
FIG. 2A is a schematic perspective view of the contact according to the first preferred embodiment.
Figure 2B:
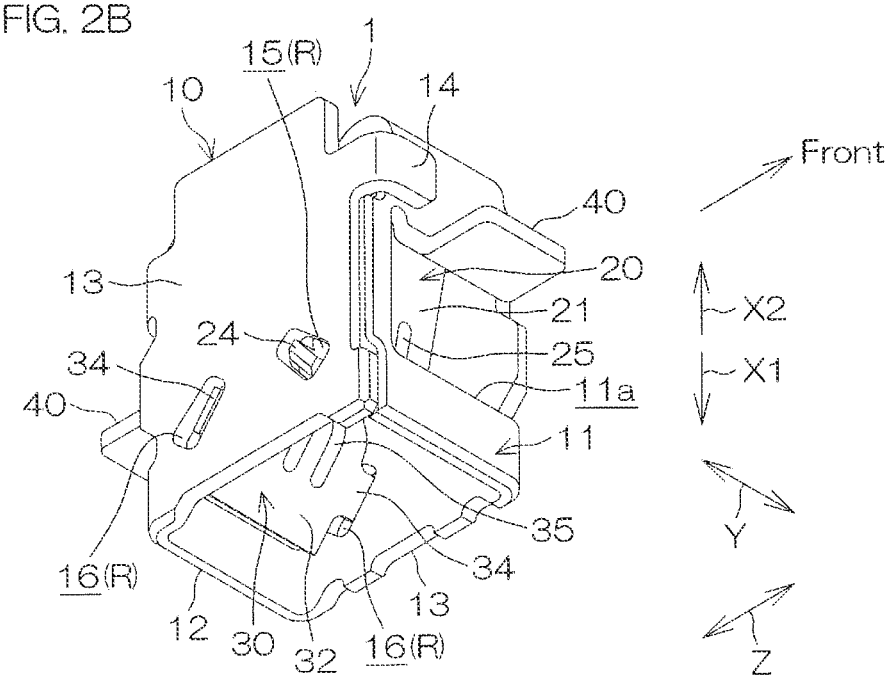
FIG. 2B is a schematic perspective view of the contact according to the first preferred embodiment when viewed at a different angle.

FIG. 2A is a schematic perspective view of the contact 1 and FIG. 2B is a schematic perspective view of the contact 1 when viewed at a different angle. As shown in FIGS. 2A and 2B, the contact 1 includes a main body portion 10, a first elastic piece portion 20 and a second elastic piece portion 30 serving as a pair of elastic piece portions, a pair of lead portions 40, and first restricting grooves 15, 16 forming restricting portions R. The contact 1 is formed of conductive material, for example, a copper alloy. The surface of the contact 1 is, for example, tin-plated. The contact 1 is formed by press molding a sheet of plate material.

The main body portion 10 is formed in a hollow box shape and has an insertion opening 10*a*. The counterpart contact 112 is arranged to be inserted through the insertion opening 10*a* into the main body portion 10 in the insertion direction X1. Specifically, the main body portion 10 includes a front wall portion 11, a rear wall portion 12, a pair of side wall portions 13, a locking piece portion 14, a pair of first restricting grooves 15 (see FIGS. 4A and 4B), and a pair of first restricting grooves 16 (see FIGS. 4A and 4B). The locking piece portion 14 is provided in a manner extending orthogonally from one of the side wall portions 13 for hook engagement with the outer surface of the front wall portion 11.

Figure 3A:
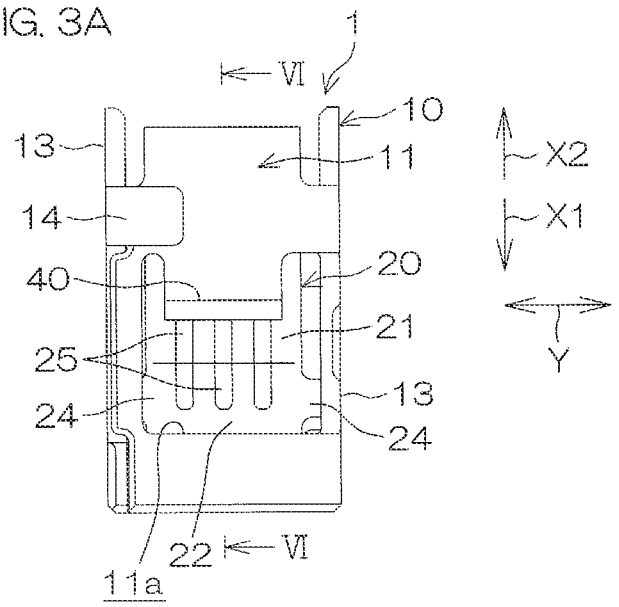
FIG. 3A is a front view of the contact according to the first preferred embodiment.
Figure 3B:
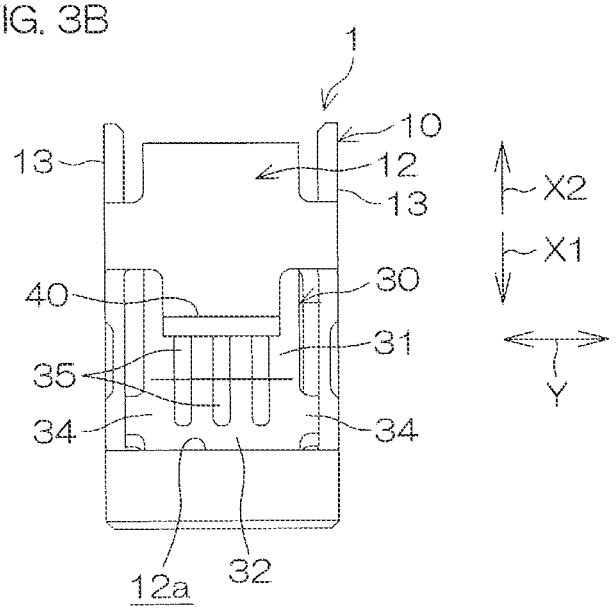
FIG. 3B is a rear view of the contact according to the first preferred embodiment.
Figure 4A:
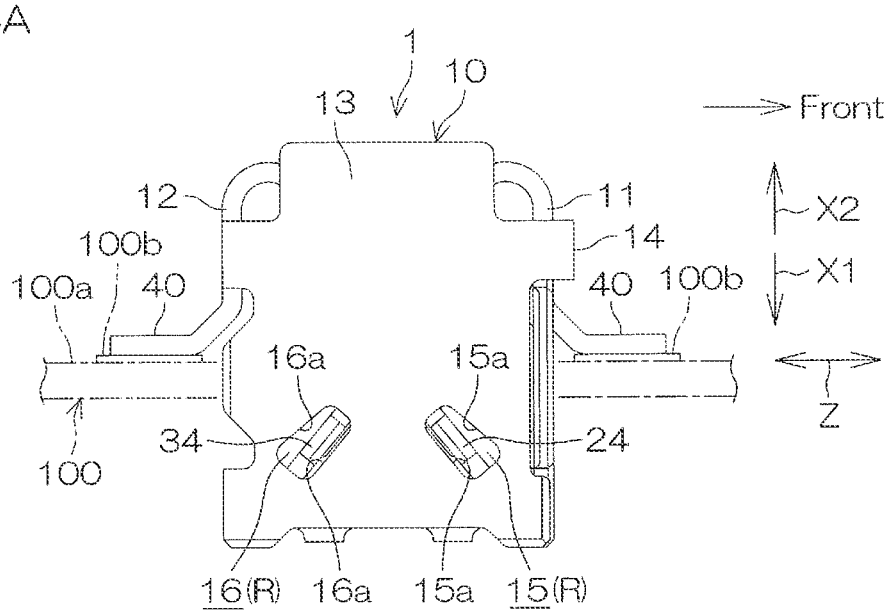
FIG. 4A is a left side view of the contact according to the first preferred embodiment.
Figure 4B:
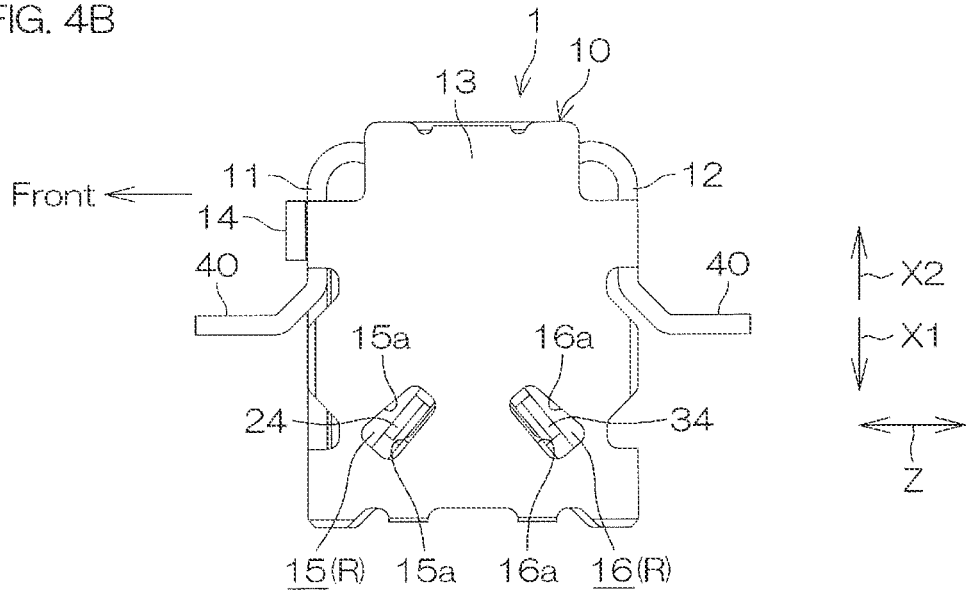
FIG. 4B is a right side view of the contact according to the first preferred embodiment.
Figure 5A:
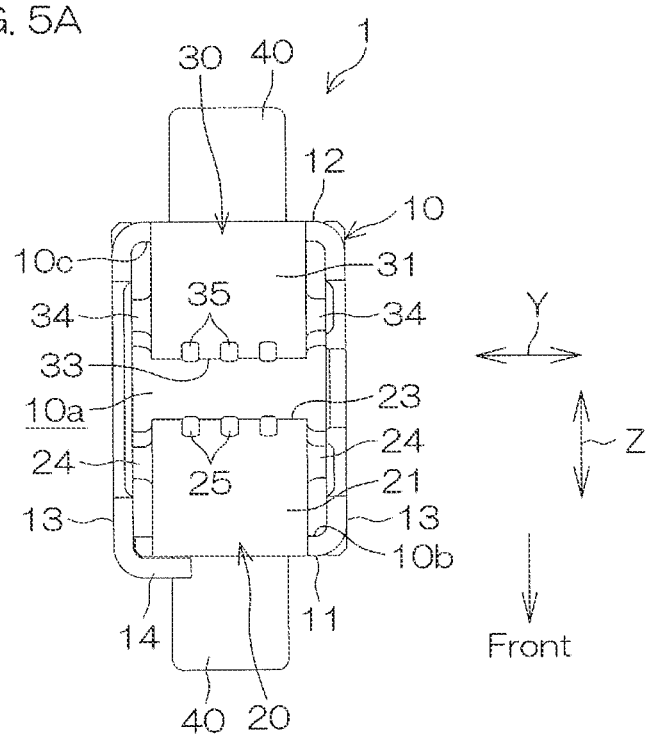
FIG. 5A is a plan view of the contact according to the first preferred embodiment.
Figure 5B:
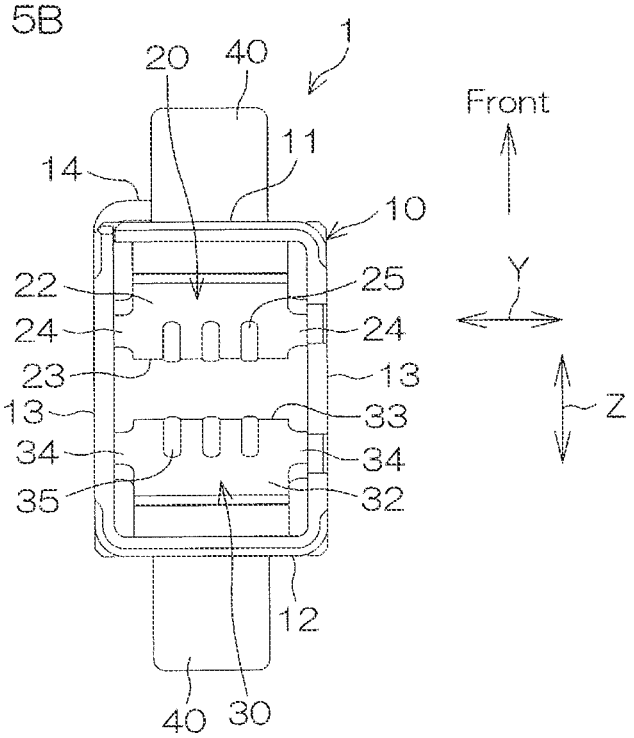
FIG. 5B is a bottom view of the contact according to the first preferred embodiment.
Figure 6:
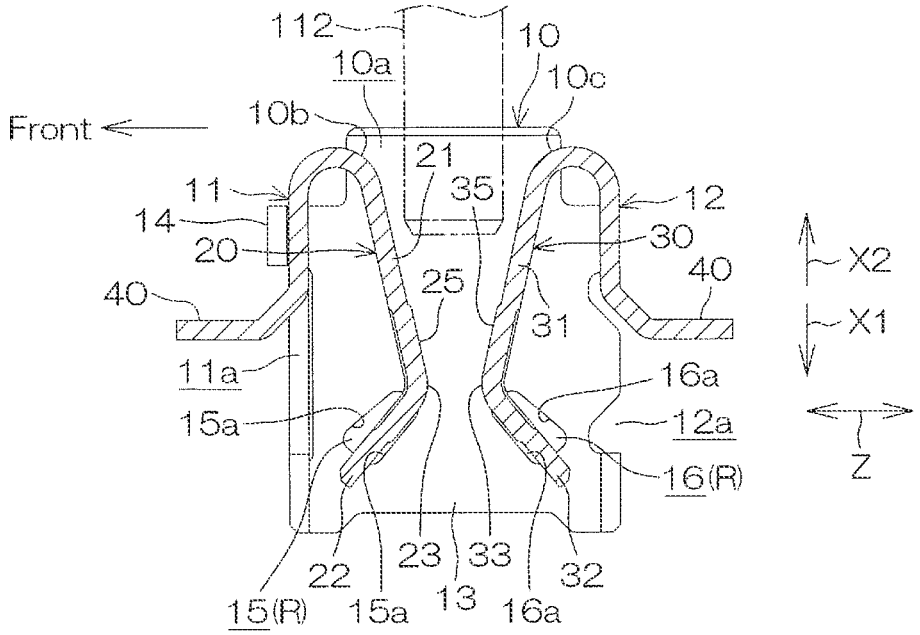
FIG. 6 is a vertical cross-sectional view of the contact according to the first preferred embodiment, corresponding to the VI-VI cross section in FIG. 3A.

FIG. 3A is a front view of the contact 1 and FIG. 3B is a rear view of the contact 1. FIG. 4A is a left side view of the contact 1 and FIG. 4B is a right side view of the contact 1. FIG. 5A is a plan view of the contact 1 and FIG. 5B is a bottom view of the contact 1. FIG. 6 is a vertical cross-sectional view of the contact 1, corresponding to the VI-VI cross section in FIG. 3A.

As shown in FIGS. 2A and 6, the first elastic piece portion 20 and the second elastic piece portion 30 are provided in a manner cantilevered and extending from the main body portion 10 and opposed to each other. The first elastic piece portion 20 and the second elastic piece portion 30 are generally provided in an inward slantwise extending manner in the insertion direction X1 from a pair of opposed edge portions 10*b*, 10*c* of the insertion opening 10*a* into the main body portion 10.

Specifically, the first elastic piece portion 20 includes a main piece portion 21, an extending piece portion 22, a contact portion 23, and a pair of first outward protrusions 24.

The main piece portion 21 is provided in an inward slantwise extending manner in the insertion direction X1 from one opposed edge portion 10*b* of the insertion opening 10*a*. The extending piece portion 22 is provided in an outward slantwise extending manner in the insertion direction X1 from an extension end of the main piece portion 21.

The main piece portion 21 and the extending piece portion 22 form an inward ridge therebetween. The contact portion 23 is arranged on top of the ridge between the main piece portion 21 and the extending piece portion 22.

As shown in FIGS. 3A, 5A, and 5B, the pair of first outward protrusions 24 protrude laterally outward from a pair of lateral edge portions of the extending piece portion 22. As shown in FIGS. 4A and 4B, the pair of first outward protrusions 24 are inserted in the respective first restricting grooves 15 that are formed, respectively, in the pair of side wall portions 13 of the main body portion 10. The first outward protrusions 24 each have a rectangular cross section. The first restricting grooves 15 in which the first outward protrusions 24 are inserted each have a fan shape expanded in the extending direction of the extending piece portion 22.

Each of the first outward protrusions 24 of the first elastic piece portion 20 engages with the inner surface 15*a* of the first restricting groove 15 (restricting portion R) of the corresponding side wall portion 13 to thereby restrict the amount of deformation of the first elastic piece portion 20. That is, the first restricting groove 15 (restricting portion R) serves to restrict the amount of deformation of the first elastic piece portion 20 less than a predetermined amount when the counterpart contact 112 is inserted.

Also, as shown in FIG. 6, the second elastic piece portion 30 includes a main piece portion 31, an extending piece portion 32, a contact portion 33, and a pair of first outward protrusions 34.

The main piece portion 31 of the second elastic piece portion 30 is provided in an inward slantwise extending manner in the insertion direction X1 from the other opposed edge portion 10*c* of the insertion opening 10*a*. The extending piece portion 32 is provided in an outward slantwise extending manner in the insertion direction X1 from an extension end of the main piece portion 31. The main piece portion 31 and the extending piece portion 32 form an inward ridge therebetween.

The contact portion 33 is arranged on top of the ridge between the main piece portion 31 and the extending piece portion 32. The contact portion 23 of the first elastic piece portion 20 and the contact portion 33 of the second elastic piece portion 30 are arranged in portions where the first elastic piece portion 20 and the second elastic piece portion 30 are mutually and proximally opposed.

As shown in FIG. 6, the counterpart contact 112, when inserted through the hollow main body portion 10, is inserted and sandwiched elastically between the contact portions 23, 33 of the elastic piece portions 20, 30. As shown in FIGS. 3A, 3B, and 6, the contact portions 23, 33 are each provided with multiple vertical ribs 25, 35 protruding inward to increase contact pressure against the counterpart contact 112.

As shown in FIGS. 3B, 5A, and 5B, the pair of first outward protrusions 34 of the second elastic piece portion 30 protrude laterally outward from a pair of lateral edge portions of the extending piece portion 32. As shown in FIGS. 4A and 4B, the pair of first outward protrusions 34 are inserted in the first restricting grooves 16 that are formed, respectively, in the pair of side wall portions 13 of the main body portion 10. The first outward protrusions 34 each have a rectangular cross section. The first restricting grooves 16 in which the first outward protrusions 34 are inserted each have a fan shape expanded in the extending direction of the extending piece portion 32.

Each of the first outward protrusions 34 of the second elastic piece portion 30 engages with the inner surface 16*a* of the corresponding first restricting groove 16 (restricting portion R) to thereby restrict the amount of deformation of the second elastic piece portion 30. The first restricting groove 16 (restricting portion R) serves to restrict the amount of deformation of the second elastic piece portion 30 less than a predetermined amount when the counterpart contact 112 is inserted.

As shown in FIG. 6, the pair of lead portions 40 are a pair of plate portions provided in a manner extending orthogonally outward, respectively, from edge portions on the opposite side of the insertion direction X1 of an opening 11*a* in the front wall portion 11 and an opening 12*a* in the rear wall portion 12 of the main body portion 10. The pair of lead portions 40 are solder connected to conductive pads 100*b* on a surface 100*a* of the circuit board 100 (see FIG. 4A) (so-called SMT (Surface Mount Technology) type). The flat side of each lead portion 40 preferably has an area that can be sucked by a suction pad used in automatic mounting of the contact 1 onto the circuit board 100.

In this preferred embodiment, as shown in FIG. 6, the restricting portions R can prevent the first elastic piece portion 20 and the second elastic piece portion 30 from being deformed excessively when the counterpart contact 112 is inserted between the first elastic piece portion 20 and the second elastic piece portion 30 within the main body portion 10.

In particular, the first elastic piece portion 20 and the second elastic piece portion 30 have the main piece portions 21, 31 inward slantwise in the insertion direction X1 and the extending piece portions 22, 32 provided outward slantwise in a manner extending from the main piece portions 21, 31 in the insertion direction X1. The first outward protrusions 24, 34 protruding laterally outward from the pair of lateral edge portions of the extending piece portions 22, 32 of the elastic piece portions 20, 30 (see FIG. 5B) are inserted, respectively, within the first restricting grooves 15, 16 (restricting portions R) in the pair of side wall portions 13 of the main body portion 10 (see FIGS. 4A and 4B). The pair of first outward protrusions 24, 34 of the elastic piece portions 20, 30 engage with the inner surfaces 15*a*, 16*a* of the corresponding first restricting grooves 15, 16 to thereby prevent the elastic piece portions 20, 30 from being deformed excessively.

In addition, the first restricting grooves 15, 16 (restricting portions R) each have a fan shape expanded in the extending direction of the corresponding extending piece portions 22, 32. This allows the inner surfaces 15*a*, 16*a* of the first restricting grooves 15, 16 to receive the rectangularly cross-sectioned first outward protrusions 24, 34, with higher positional accuracy, even when displaced with the deformation of the corresponding elastic piece portions 20, 30. Accordingly, the amount of deformation of the elastic piece portions 20, 30 can be restricted with high accuracy.

Second Preferred Embodiment

Figure 7A:
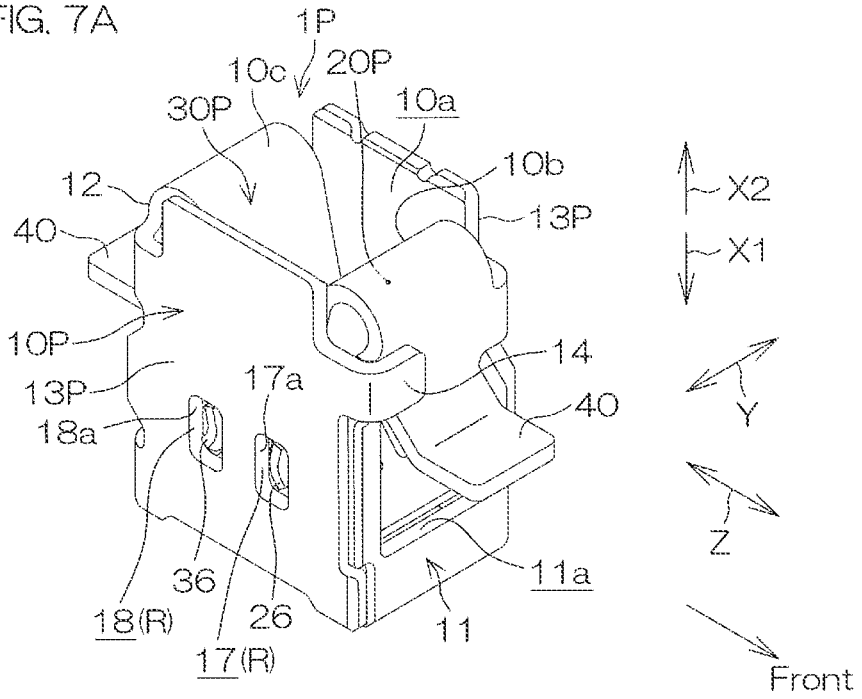
FIG. 7A is a schematic perspective view of a contact according to a second preferred embodiment of the present invention.
Figure 7B:
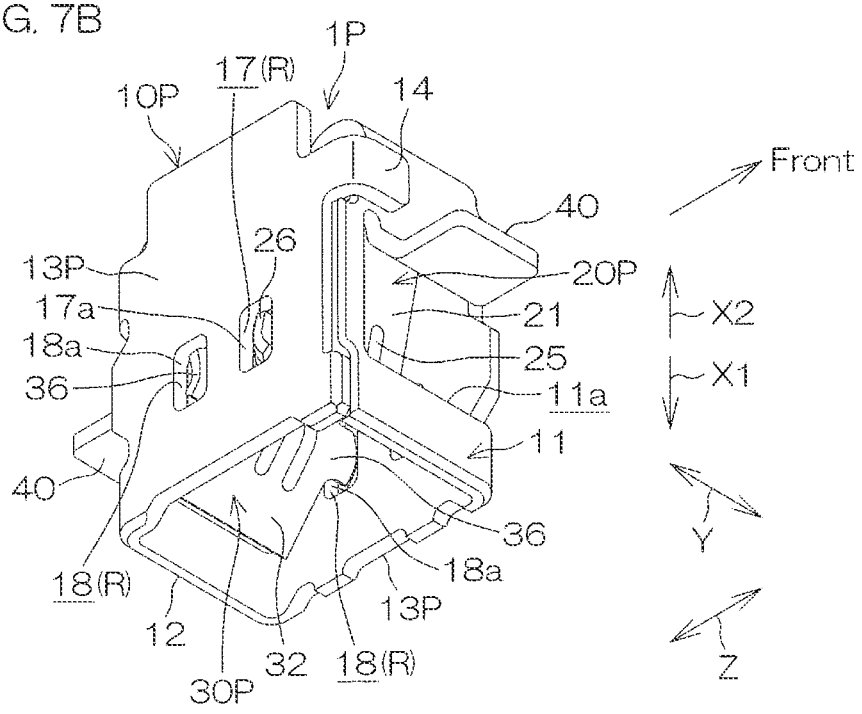
FIG. 7B is a schematic perspective view of the contact according to the second preferred embodiment when viewed at a different angle.
Figure 8A:
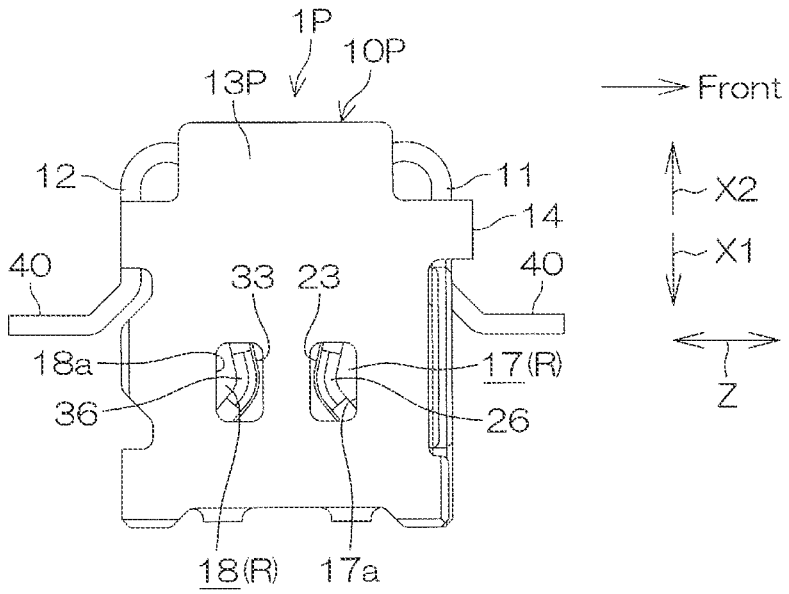
FIG. 8A is a left side view of the contact according to the second preferred embodiment.
Figure 8B:
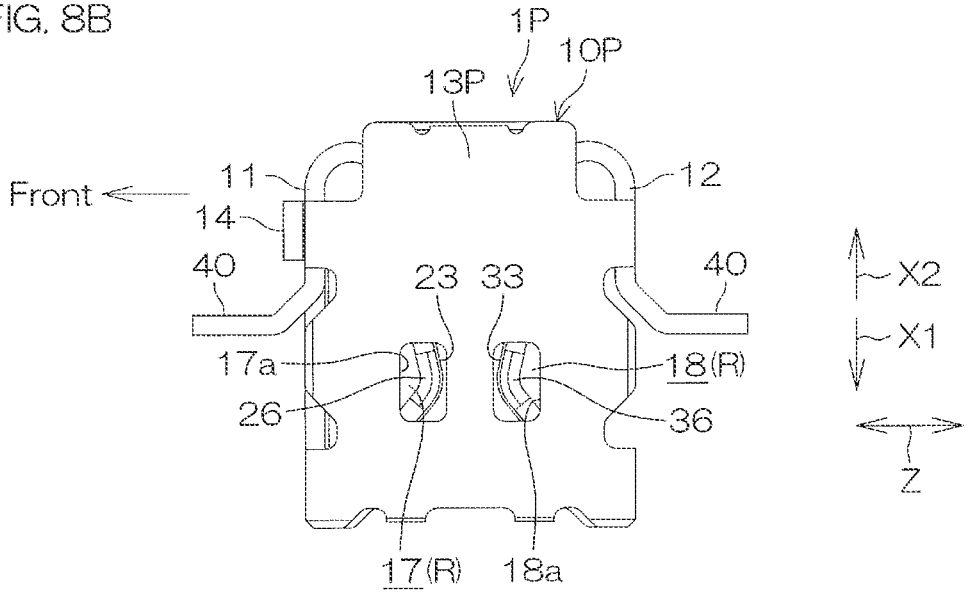
FIG. 8B is a right side view of the contact according to the second preferred embodiment.

FIG. 7A is a schematic perspective view of a contact 1P according to a second preferred embodiment of the present invention and FIG. 7B is a schematic perspective view of the contact 1P when viewed at a different angle. FIG. 8A is a left side view of the contact 1P and FIG. 8B is a right side view of the contact 1P.

The contact 1P according to the second preferred embodiment shown in FIGS. 7A, 7B, 8A, and 8B is different from the contact 1 according to the first preferred embodiment shown in FIGS. 2A, 2B, 4A, and 4B mainly in the following point. That is, the contact 1P includes a main body portion 10P having a pair of side wall portions 13P, a first elastic piece portion 20P, and a second elastic piece portion 30P.

The first elastic piece portion 20P includes a pair of second outward protrusions 26 provided in a manner extending laterally outward from a pair of lateral edge portions of the contact portion 23. The pair of second outward protrusions 26 are inserted in the second restricting grooves 17 (restricting portions R) that are formed, respectively, in the pair of side wall portions 13P of the main body portion 10P. Since the contact portion 23 is provided on top of the ridge, the second outward protrusions 26 are each formed to have a bent cross section, specifically, a V-shaped cross section when viewed laterally. The second restricting grooves 17 are each formed to have an approximately rectangular shape.

The second elastic piece portion 30P includes a pair of second outward protrusions 36 provided in a manner extending laterally outward from a pair of lateral edge portions of the contact portion 33. The pair of second outward protrusions 36 are inserted in the respective second restricting grooves 18 (restricting portions R) that are formed, respectively, in the pair of side wall portions 13P of the main body portion 10P. Since the contact portion 33 is provided on top of the ridge, the second outward protrusions 36 are each formed to have a bent cross section, specifically, a V-shaped cross section when viewed laterally. The second restricting grooves 18 are each formed to have an approximately rectangular shape.

In the second preferred embodiment shown in FIGS. 7A to 8B, components common to the first preferred embodiment shown in FIGS. 2A, 2B, 4A, and 4B are designated by the same reference signs.

In this preferred embodiment, the pair of second outward protrusions 26, 36 provided in a manner extending laterally outward from the pair of lateral edge portions of the contact portions 23, 33 of the elastic piece portions 20P, 30P are inserted, respectively, within the corresponding second restricting grooves 17, 18 (restricting portions R) in the pair of side wall portions 13P of the main body portion 10P. When the counterpart contact 112 (see FIGS. 1A and 1B) is inserted between the first elastic piece portion 20P and the second elastic piece portion 30P within the main body portion 10P, the second outward protrusions 26, 36 engage with the inner surfaces 17*a*, 18*a* of the corresponding second restricting grooves 17, 18 to thereby prevent the elastic piece portions 20P, 30P from being deformed excessively.

In addition, the second outward protrusions 26, 36 are formed to have a bent cross section (V-shaped cross section), resulting in an increase in the strength. This allows to reliably prevent the elastic piece portions 20P, 30P from being deformed excessively.

Third Preferred Embodiment

Figure 9A:
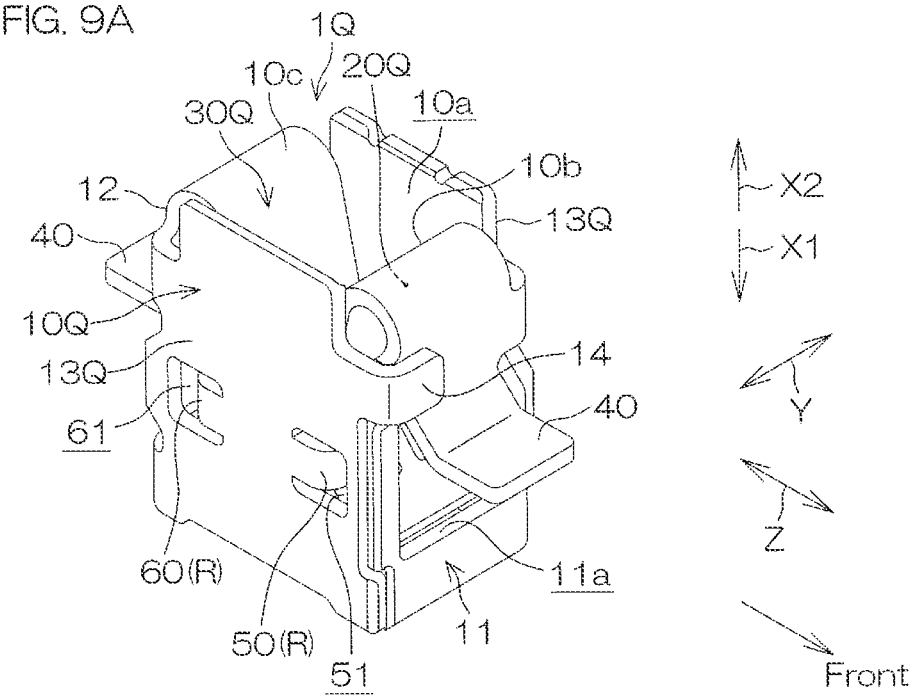
FIG. 9A is a schematic perspective view of a contact according to a third preferred embodiment of the present invention.
Figure 9B:
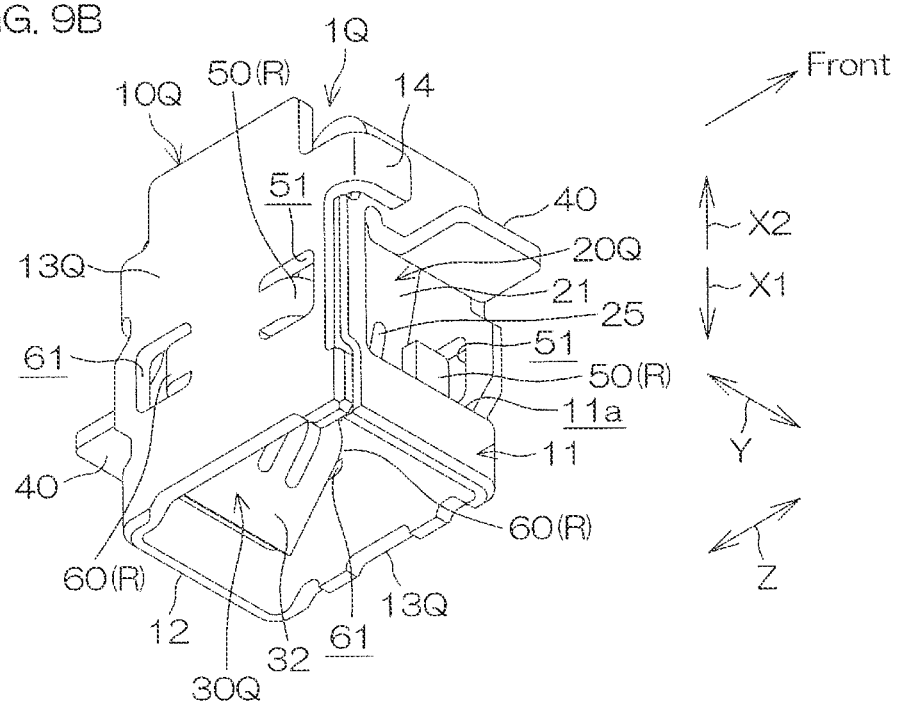
FIG. 9B is a schematic perspective view of the contact according to the third preferred embodiment when viewed at a different angle.
Figure 10A:
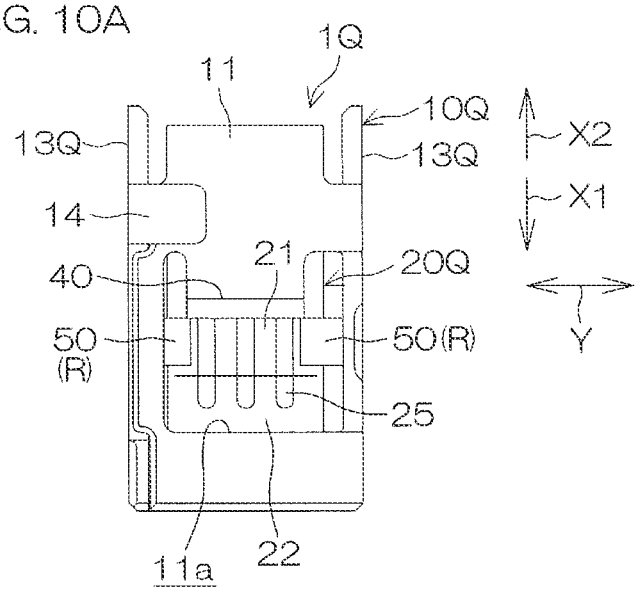
FIG. 10A is a front view of the contact according to the third preferred embodiment.
Figure 10B:
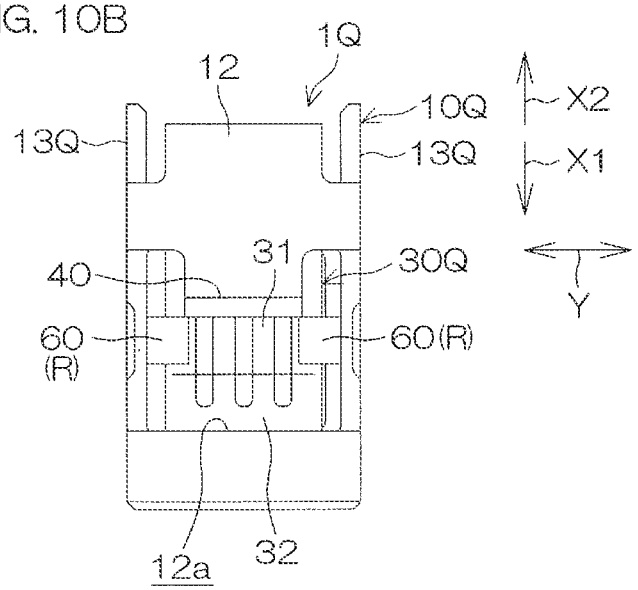
FIG. 10B is a rear view of the contact according to the third preferred embodiment.
Figure 11A:
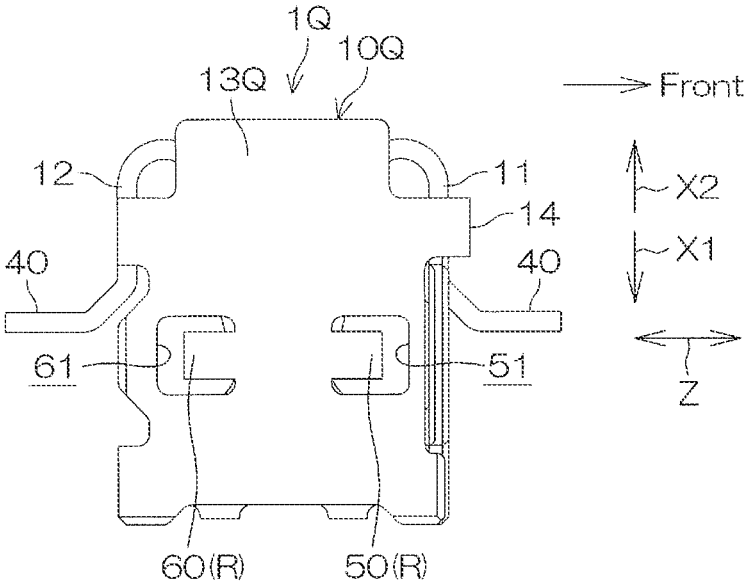
FIG. 11A is a left side view of the contact according to the third preferred embodiment.
Figure 11B:
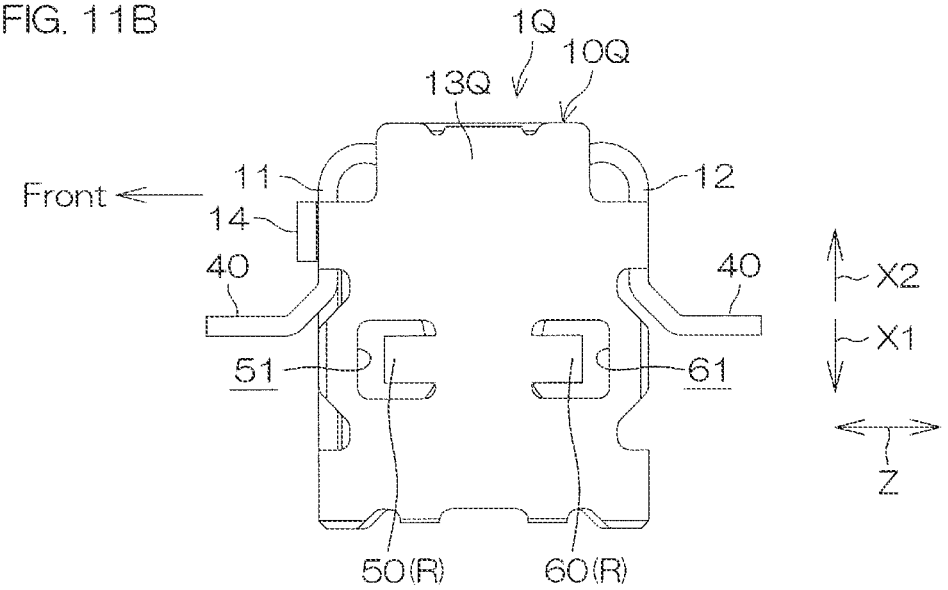
FIG. 11B is a right side view of the contact according to the third preferred embodiment.
Figure 12A:
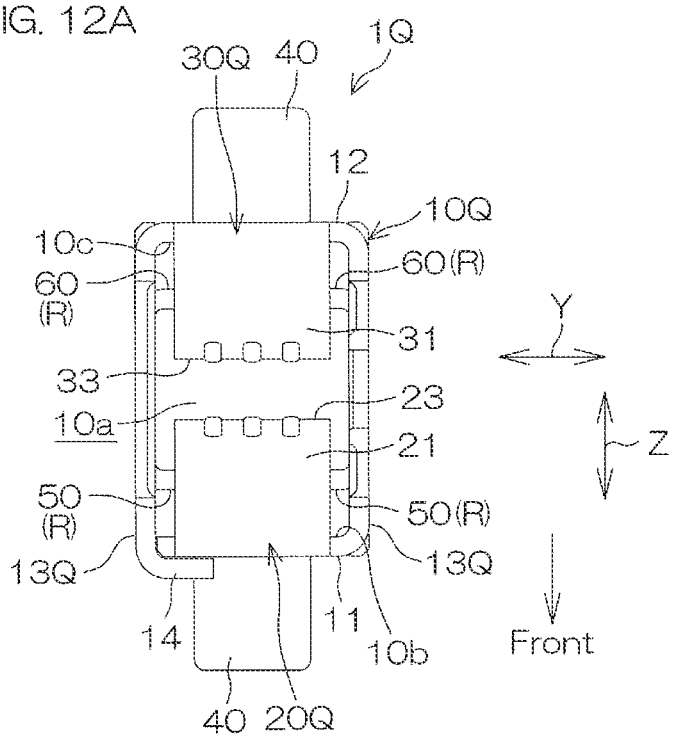
FIG. 12A is a plan view of the contact according to the third preferred embodiment.
Figure 12B:
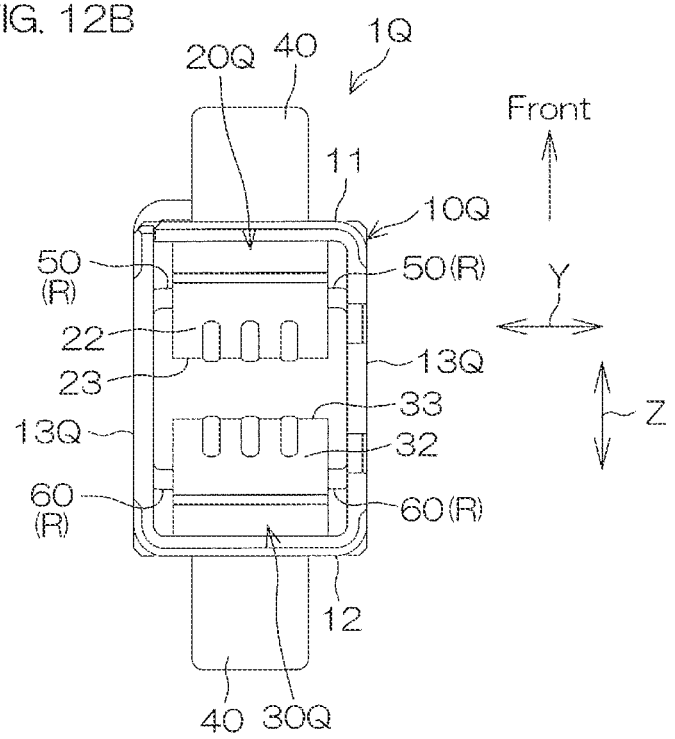
FIG. 12B is a bottom view of the contact according to the third preferred embodiment.

FIG. 9A is a schematic perspective view of a contact 1Q according to a third preferred embodiment of the present invention and FIG. 9B is a schematic perspective view of the contact 1Q when viewed at a different angle. FIG. 10A is a front view of the contact 1Q and FIG. 10B is a rear view of the contact 1Q. FIG. 11A is a left side view of the contact 1Q and FIG. 11B is a right side view of the contact 10. FIG. 12A is a plan view of the contact 1Q and FIG. 12B is a bottom view of the contact 1Q.

The contact 10 according to the third preferred embodiment shown in FIGS. 9A to 12B is different from the contact 1 according to the first preferred embodiment shown in FIGS. 1A to 6 mainly in the following point.

That is, as shown in FIGS. 9A and 9B, the contact 1Q includes a main body portion 10Q having a pair of side wall portions 13Q, a first elastic piece portion 20Q, and a second elastic piece portion 30Q. The first elastic piece portion 20Q is not provided with such a first outward protrusion 24 as in the first preferred embodiment. Similarly, the second elastic piece portion 30Q is not provided with such a first outward protrusion 34 as in the first preferred embodiment.

As shown in FIGS. 10A to 12B, the restricting portions R for restriction of the amount of deformation of the first elastic piece portion 20Q are constituted by a pair of restricting protrusions 50 formed in a manner protruding inward from the pair of side wall portions 13Q of the main body portion 10Q. The restricting protrusions 50 are each formed by a plate portion provided in a manner extending orthogonally inward from an edge portion of an opening 51 that is formed in each side wall portion 13Q. As shown in FIG. 10A, the pair of restricting protrusions 50 (restricting portions R) engage with the main piece portion 21 of the first elastic piece portion 20Q to thereby restrict the amount of deformation of the first elastic piece portion 20Q.

As shown in FIGS. 10A to 12B, the restricting portions R for restriction of the amount of deformation of the second elastic piece portion 30Q are constituted by a pair of restricting protrusions 60 formed in a manner protruding inward from the pair of side wall portions 13Q of the main body portion 10Q. The restricting protrusions 60 are each formed by a plate portion provided in a manner extending orthogonally inward from an edge portion of an opening 61 that is formed in each side wall portion 13Q. As shown in FIG. 10B, the pair of restricting protrusions 60 (restricting portions R) engage with the main piece portion 31 of the second elastic piece portion 30Q to thereby restrict the amount of deformation of the second elastic piece portion 30Q.

In the third preferred embodiment shown in FIGS. 9A to 12B, components common to the first preferred embodiment shown in FIGS. 1A to 6 are designated by the same reference signs.

In this preferred embodiment, when the counterpart contact 112 (see FIGS. 1A and 1B) is inserted between the first elastic piece portion 20Q and the second elastic piece portion 300 within the main body portion 10Q, the restricting protrusions 50, 60 formed in a manner protruding from the pair of side wall portions 13Q of the main body portion 10Q engage with the corresponding elastic piece portions 20Q, 30Q to thereby prevent the elastic piece portions 20Q, 30Q from being deformed excessively.

Fourth Preferred Embodiment

Figure 13A:
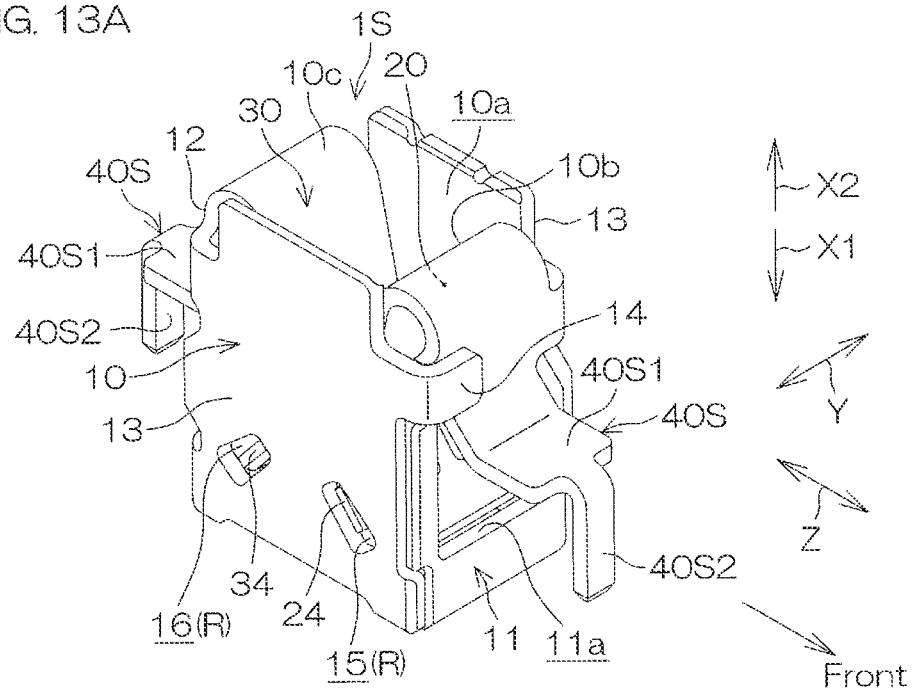
FIG. 13A is a schematic perspective view of a contact according to a fourth preferred embodiment of the present invention.
Figure 13B:
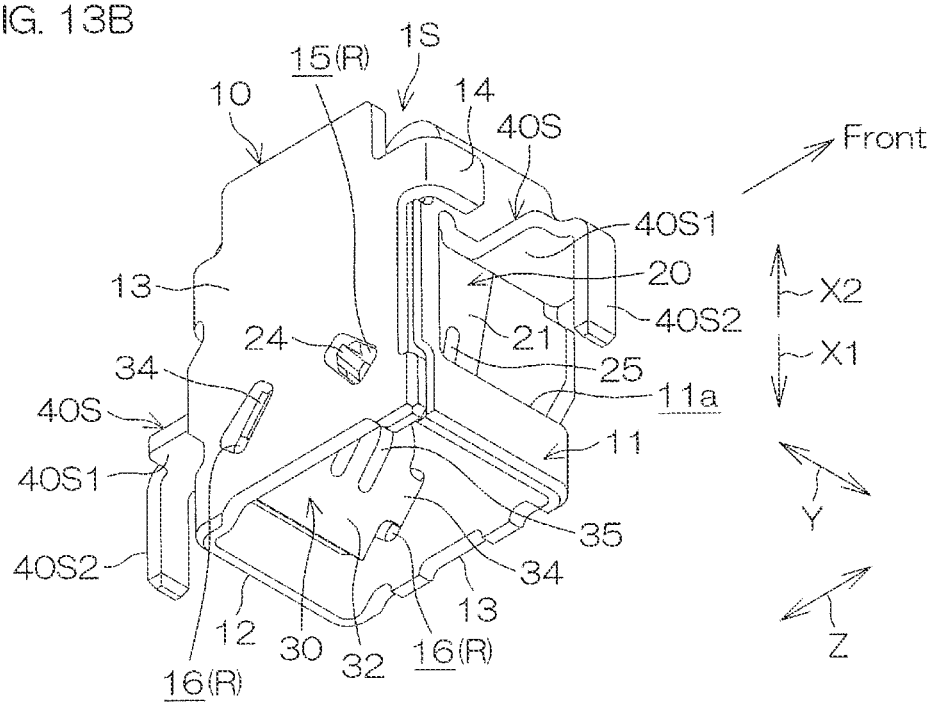
FIG. 13B is a schematic perspective view of the contact according to the fourth preferred embodiment when viewed at a different angle.

FIG. 13A is a schematic perspective view of a contact 1S according to a fourth preferred embodiment of the present invention and FIG. 13B is a schematic perspective view of the contact 1S when viewed at a different angle.

The contact 1S according to the fourth preferred embodiment shown in FIGS. 13A and 13B is different from the contact 1 according to the first preferred embodiment shown in FIGS. 2A and 2B in that each lead portion 40S includes a leg portion 40S1 arranged on the surface 100*a* of the circuit board 100 (see FIG. 4A) and a pin-shaped protrusion 40S2 provided in a manner extending orthogonally from the leg portion 40S1 and penetrating the circuit board 100 to be soldered on the underside of the circuit board 100 (so-called DIP (Dual-in-line package) type). In the fourth preferred embodiment shown in FIGS. 13A and 13B, components common to the first preferred embodiment shown in FIGS. 2A and 2B are designated by the same reference signs.

The present invention is not intended to be limited to the above-described preferred embodiments, but each contact may be received and held within a resin housing, for example. Alternatively, not only a motor but also a common electronic device may be connected to the contacts.

While the present invention has heretofore been described in detail with reference to the practical aspects, variations, modifications, and equivalents thereto will readily occur to one of ordinary skill in the art who has understood the description above. Accordingly, the present invention should be construed as being limited only by the appended claims and equivalents thereof.

REFERENCE SIGNS LIST

1; 1P; 1Q; 1S Contact
10; 10P; 10Q Main body portion
10*a* Insertion opening
10*b*, 10*c* Opposed edge portion
11 Front wall portion
12 Rear wall portion
13; 13P; 13Q Side wall portion
15 First restricting groove (restricting portion)
15*a* Inner surface
16 First restricting groove (restricting portion)
16*a* Inner surface
17 Second restricting groove (restricting portion)
17*a* Inner surface
18 Second restricting groove (restricting portion)
18*a* Inner surface
20; 20P; 20Q First elastic piece portion
21 Main piece portion
22 Extending piece portion
23 Contact portion
24 First outward protrusion
26 Second outward protrusion
30; 30P; 30Q Second elastic piece portion
31 Main piece portion
32 Extending piece portion
33 Contact portion
34 First outward protrusion
36 Second outward protrusion
50 Restricting protrusion (restricting portion)
60 Restricting protrusion (restricting portion)
100 Circuit board
110 Motor
112 Counterpart contact
R Restricting portion
X1 Insertion direction

What is claimed is:

1. A contact comprising:

a hollow box-shaped main body portion formed with an insertion opening into which a plate-shaped counterpart contact is inserted in an insertion direction;

a pair of cantilevered elastic piece portions provided in an inward slantwise extending manner in the insertion direction from a pair of opposed edge portions of the insertion opening into the main body portion, the elastic piece portions having contact portions arranged in mutually proximal portions; and a pair of restricting portions provided on the main body portion and each arranged to restrict an amount of deformation of a corresponding one of the elastic piece portions when the counterpart contact is inserted, wherein the pair of elastic piece portions include a pair of first outward protrusions, and wherein the pair of first outward protrusions of a corresponding one of the elastic piece portions respectively engage with a pair of side wall portions of the main body portion.

2. The contact according to claim 1, wherein the pair of elastic piece portions further include a pair of main piece portions provided inward slantwise in the insertion direction, and a pair of extending piece portions provided in an outward slantwise extending manner in the insertion direction from the pair of main piece portions, wherein the pair of first outward protrusions protrude laterally outward from a pair of lateral edge portions of each of the extending piece portions, the contact portions are each arranged on top of a ridge between each main piece portion and each extending piece portion, and each of the restricting portions includes a pair of first restricting grooves formed in the pair of side wall portions of the main body portion, into which the pair of first outward protrusions of a corresponding one of the elastic piece portions are inserted respectively.

3. The contact according to claim 2, wherein each of the first outward protrusions has a rectangular cross section, and each of the first restricting grooves has a fan shape expanded in an extension direction of each of the extending piece portions in which a corresponding one of the first outward protrusions is provided in an extending manner.

4. The contact according to claim 1, further comprising a pair of second outward protrusions provided in a manner extending laterally outward from a pair of lateral edge portions of each of the contact portions of the elastic piece portions, wherein each of the restricting portions includes a pair of second restricting grooves formed in a pair of side wall portions of the main body portion, into which the pair of second outward protrusions of a corresponding one of the elastic piece portions are inserted respectively.

5. The contact according to claim 1, wherein each of the restricting portions includes restricting protrusions formed in a manner protruding from a pair of side wall portions of the main body portion and arranged to engage with the elastic piece portions in a corresponding manner.

* * * * *